US011896079B2

(12) United States Patent
Moretti Polegato et al.

(10) Patent No.: US 11,896,079 B2
(45) Date of Patent: Feb. 13, 2024

(54) FOOTWEAR SOLE

(71) Applicant: GEOX S.p.A., Montebelluna (IT)

(72) Inventors: Mario Moretti Polegato, Montebelluna (IT); Livio Poloni, Montebelluna (IT)

(73) Assignee: GEOX S.p.A., Montebelluna (IT)

( * ) Notice: Subject to any disclaimer, the term of this patent is extended or adjusted under 35 U.S.C. 154(b) by 352 days.

(21) Appl. No.: 17/289,010

(22) PCT Filed: Oct. 24, 2019

(86) PCT No.: PCT/IB2019/059101

§ 371 (c)(1),
(2) Date: Apr. 27, 2021

(87) PCT Pub. No.: WO2020/099963

PCT Pub. Date: May 22, 2020

(65) Prior Publication Data

US 2021/0401116 A1 Dec. 30, 2021

(30) Foreign Application Priority Data

Nov. 12, 2018 (IT) ..... 102018000010239

(51) Int. Cl.
*A43B 13/18* (2006.01)
*A43B 21/26* (2006.01)
*A43B 7/1455* (2022.01)

(52) U.S. Cl.
CPC ..... *A43B 13/185* (2013.01); *A43B 7/146* (2013.01); *A43B 13/181* (2013.01); *A43B 21/26* (2013.01)

(58) Field of Classification Search
CPC ..... A43B 21/26; A43B 13/18; A43B 13/181; A43B 13/185; A43B 7/146
(Continued)

(56) References Cited

U.S. PATENT DOCUMENTS 4,535,553 A * 8/1985 Derderian ..... A43B 13/181 36/28
5,853,844 A 12/1998 Wen
(Continued)

FOREIGN PATENT DOCUMENTS

EP 0 841 019 A2 5/1998

OTHER PUBLICATIONS

International Search Report and Written Opinion dated Jan. 3, 2020 in PCT/IB2019/059101 filed Oct. 24, 2019.

*Primary Examiner* — Marie D Bays
(74) *Attorney, Agent, or Firm* — Oblon, McClelland, Maier & Neustadt, L.L.P.

(57) ABSTRACT

A footwear sole obtained by molding a single polymeric material, the footwear sole includes a lower surface to contact the ground, and an upper surface to support an insole and, on the upper surface, at least one elastically deformable cushioning element. The cushioning element includes an elongated element cantileverly protruding from the upper surface, and a plurality of tabs extending from the upper surface that are arranged around the elongated element, thereby defining a dome. In an undeformed configuration of the cushioning element the tabs are upright, and there is a gap between the tabs and the elongated element, and in a deformed configuration of the cushioning element the tabs are each bent towards the elongated element and in abutment against it. The switching from the undeformed to the deformed causes the area of the bearing surface provided to the insole by each cushioning element to gradually increase.

16 Claims, 3 Drawing Sheets

(58) Field of Classification Search
USPC ..... 36/28
See application file for complete search history.

(56) References Cited

U.S. PATENT DOCUMENTS

| | | | | |
|---|---|---|---|---|
| 2006/0064900 | A1* | 3/2006 | Aveni | A43B 13/186 36/27 |
| 2009/0139114 | A1* | 6/2009 | Malek | A43B 7/144 36/35 B |
| 2009/0293311 | A1* | 12/2009 | Sun | A43B 7/146 36/102 |
| 2012/0048663 | A1* | 3/2012 | McDonnell | A43B 13/189 188/266 |
| 2015/0354662 | A1* | 12/2015 | McDonnell | A43B 13/206 188/269 |
| 2016/0347027 | A1* | 12/2016 | Chen | B32B 3/266 |
| 2016/0353840 | A1* | 12/2016 | Mason | A43B 17/00 |
| 2018/0317600 | A1* | 11/2018 | Campos | A43B 13/187 |
| 2019/0154101 | A1 | 5/2019 | McDonnell | |
| 2020/0359737 | A1* | 11/2020 | Sung | A43B 13/181 |
| 2021/0186151 | A1* | 6/2021 | Gross | A43B 13/181 |
| 2021/0212892 | A1* | 7/2021 | Seo | A43B 7/146 |

* cited by examiner

FIG.7
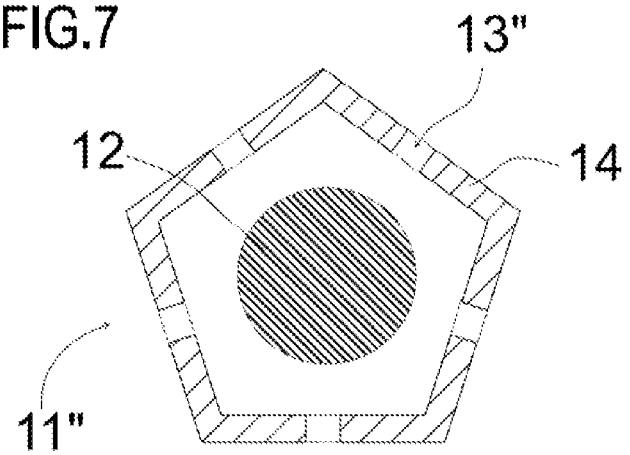
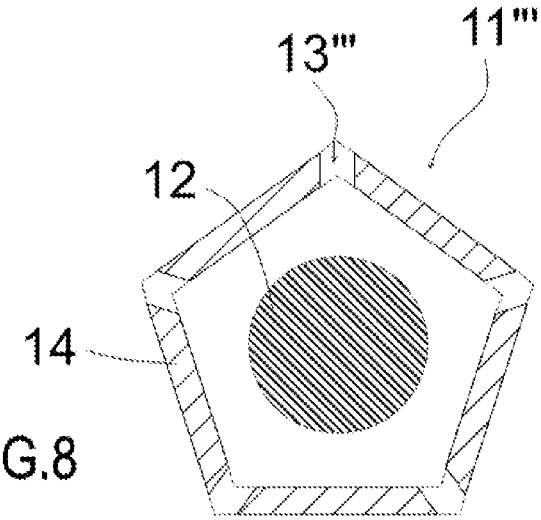
FIG.8
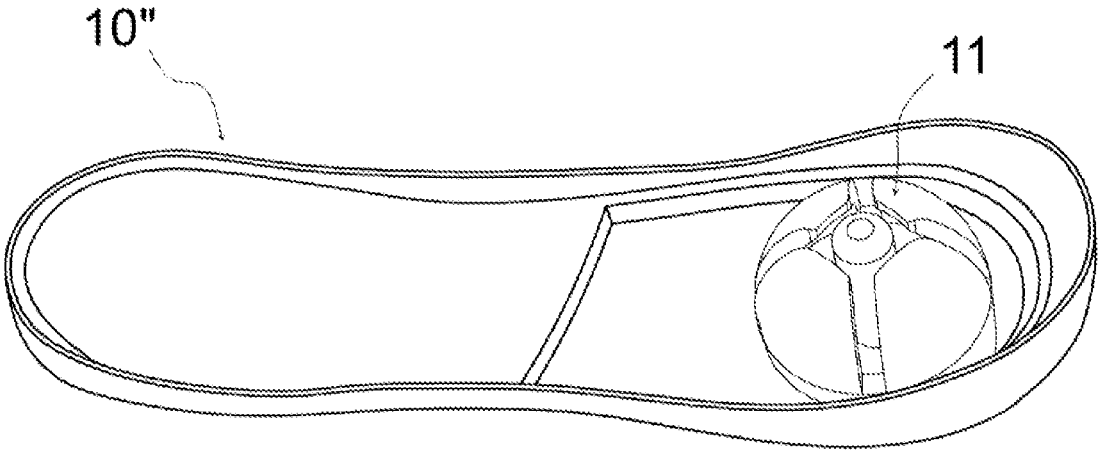
FIG.9

FOOTWEAR SOLE

FIELD OF THE INVENTION

The present invention relates to the field of footwear, and especially refers to a particularly comfortable footwear sole characterized by high capacity to absorb the stresses it undergoes during use.

STATE OF THE ART

Footwear generally comprises a sole and an upper assembly fixed above the sole. The upper assembly comprises an insole through which the user's weight is transferred onto the sole. The stresses generated by reaction to the weight force of the user himself and the stresses caused by impacts of the sole with the ground or other obstacles are also transmitted from the sole to the wearer's foot through the insole.

Recently, footwear soles made of polymeric materials such as rubber have been designed and obtained by molding techniques, which compared to soles obtained with the techniques previously used make the footwear more comfortable, because they better cushion the impacts and provide valid support for the weight of the footwear's wearer.

In particular, molded soles provided with elastically deformable elements at the surface intended to face the insole are known. Part of the energy generated by impacts of the sole against the ground and by weight caused to be transferred to the sole by the wearer when walking is absorbed by the deformation of the deformable elements; when the stresses cease, the deformable elements return to their original configuration.

In this description the expression vertical direction identifies a direction orthogonal to the plane on which the sole rests, and the expression longitudinal direction identifies a direction parallel to the length of the sole between the heel and the toe.

EP-A-0875163 (Valleverde) describes a molded sole provided with a plurality of dome-shaped elements extending in vertical direction, i.e. which remain oriented towards the insole of the upper, and in contact with the insole when the footwear is assembled. Each dome-shaped element delimits what in the document is named "elastic chamber", i.e. a volume inside the dome-shaped element itself that has the function of containing air. The dome-shaped elements are perforated, i.e. a through hole makes the inner volume communicating with the outside; air enters the inside of the dome-shaped element from the respective hole and is expelled from the same hole. Each dome-shaped element is free of geometric discontinuities, except for the hole just described, in the sense that the hole is the only opening provided through the dome. The dome-shaped elements are elastically deformable in vertical direction: in the undeformed configuration they are substantially hemispherical, and in the deformed configuration they are partially flattened and take a shape reminding that of a cushion or a red blood cell. Since the hole faces the insole of the upper, when a dome-shaped element is caused to switch from the undeformed to the deformed configuration, a certain amount of air initially present inside the dome-shaped element is expelled through the hole in the direction of the insole and, conversely, when a dome-shaped element is caused to switch from the deformed to the undeformed configuration, a certain amount of air initially present at the insole of the upper is sucked in through the hole inside the dome-shaped element, in order to create microcirculation of air that helps to keep the foot cool and dry. In an embodiment, shown in FIGS. 4 and 5, a conical protrusion is provided inside the dome-shaped elements, the conical protrusion cantileverly extending in vertical direction, from the base of the dome-shaped element and towards the respective hole, but without intercepting the latter. The protrusion is not deformable. Thanks to the protrusion and the size of the hole, the dome-shaped elements cannot completely collapse under the action of outer stresses: in the deformed configuration, in fact, the hole is closed by the protrusion and the air that is still inside, i.e. the volume of air that has not been expelled through the hole during deformation remains blocked and, as would happen in an air chamber, generates a backpressure that prevents the dome-shaped element from further deforming until it collapses. This compromise solution allows an initial microcirculation of air and some cushioning effect to be achieved. In practice, when a stress causes the deformation of a dome-shaped element, first an air volume is expelled from the inside of the dome-shaped element towards the insole of the upper, and when the deformation causes the hole to be blocked by part of the protrusion, the dome-shaped element becomes an air chamber as a result of the air supporting the dome-shaped element from the inside; when the stress is eliminated, the dome-shaped element returns to its undeformed configuration, thereby drawing back therein a volume of air corresponding to the one initially expelled.

In the deformed configuration, the air contained inside the dome-shaped elements allows a cushioning effect to be achieved. However, in the solution described in EP-A-0875163, the cushioning function of the dome-shaped elements is subordinated to the ability to create air microcirculation: the volume of air coming out of the dome-shaped elements during deformation is greater than the volume of air remaining inside the dome-shaped elements to support the weight of the wearer and to cushion the stresses. This results in a very low cushioning capacity.

The above described solution has a further limitation in that, due to the shape of the dome-shaped elements their deformations can take place mainly in vertical direction, i.e. along their height, orthogonally to the ground on which the sole rests, the chances of being able to deform in a transverse direction, i.e. parallel to the ground, being minimal. This way, from the undeformed configuration to the deformed configuration, the surface on which the wearer's weight is distributed remains substantially unchanged, or varies slightly; as a result, there is no progression in the wearer's support: the amount of the reaction transmitted by the dome-shaped elements to the user's foot remains substantially constant during deformation, i.e. during walking.

EP-A-2366300 (Gommus) describes a molded sole whose upper surface, intended to be fixed to the insole of an upper, consists of a plurality of convex semicircular profiles, adjacent to each other, transverse with respect to the longitudinal heel-tip direction of the sole itself. Each profile is halved by a central septum extending vertically and ending in a flat fin; the flat fins and the edges of the convex profiles together define the bearing plane of the insole of the upper. The central septum is not appreciably flattened by the stresses created by the weight of the shoe wearer while walking. The weight of the wearer is distributed on the surface of the bearing plane, the surface remaining substantially unchanged as the applied weight varies, so even this solution does not provide a progressive effect of cushioning. In addition, the structure with transverse tubular profiles affects the appearance of the sole, because it significantly limits the possible construction choices.

EP-A-2485618 (Bibo) describes a molded sole comprising a plurality of truncated-cone chambers open on top, towards the insole of the upper of the assembled shoe. The truncated-cone chambers are not deformable. The base of the truncated-cone chambers is wider than the top opening. An elastically deformable cylindrical stem cantileverly extends into each truncated-cone chamber in vertical direction from the respective base and through the top opening. The free end of the cylindrical stem is wider than the remaining portion of the stem, i.e. the stem has a mushroom shape; the end portion is named "cap". In the undeformed configuration of the stem, the cap is outside the respective truncated-cone chamber and does not intercept the top opening; the air is free to move through the top opening. In the deformed stem configuration of the stem, the cap closes the top opening of the corresponding truncated-cone chamber. Therefore, during the walk, initially, the pressure applied by the wearer on the insole causes the deformation of the cylindrical stems which, being flattened, in turn close the respective truncated-cone chambers from the top. The air comes out of a lower secondary hole, which opens through the sole and has smaller diameter with respect to the top opening; if the ground is wet, the air jet coming out of the secondary hole limits the rise of water inside the truncated-cone chamber. At a later time, when the foot is lifted, the undeformed configuration of the cylindrical stems is restored, thereby opening the upper openings of the respective truncated-cone chambers and allowing air to pass through the top opening.

The technical solutions described, and in general the known art, prefer the microcirculation of air to the cushioning capacity.

SUMMARY OF THE INVENTION

A first the technical problem underlying this invention is therefore to provide a sole that gives high performance in terms of cushioning capacity, that is to say a sole that can effectively cushion the shocks the respective footwear is subjected to, thus transferring minimal stresses to the user's foot.

A second technical problem is to make a sole, preferably made of a single polymer material, not only characterized by high cushioning capacity but also providing a response as progressive as possible to the pressure given by the wearer of the footwear during the walk.

A further object is to fabricate the cushioned sole at low cost, by using known techniques.

Therefore, the present invention relates to a sole according to claim 1.

In particular, the sole comprises a lower surface intended to come into contact with the ground, and an upper surface intended to support an insole, such as the insole of an upper assembly. The sole further comprises one or more elastically deformable cushioning elements positioned on the upper surface of the same sole. The cushioning elements in turn comprise an elongated element cantileverly protruding from the upper surface of the sole, and a plurality of tabs extending from the upper surface of the sole, around the elongated element. It is also possible to arrange several elongated elements close to each other and altogether surrounded by the tabs.

In an undeformed configuration of the cushioning elements the tabs extend vertically, undeformed, and preferably there is a gap between the tabs and the elongated element; in a deformed configuration of the cushioning elements the tabs are each bent towards the elongated element, or towards the elongated elements if more than one, and in abutment against it or them.

Now, for the sake of simplicity, reference will be made to the case in which the cushioning elements are equipped with a single elongated element between the tabs, but the following is also true in case the elongated elements are more than one, for example two, three or four.

The above described solution provides many advantages, taking into account that the switching from the undeformed to the deformed configuration of the cushioning elements occurs when the wearer of the footwear, while walking, transfers his weight onto the sole and, conversely, the elastic recovery to the undeformed configuration occurs when the wearer lifts the foot and footwear or otherwise removes his weight from the latter.

First of all, the cushioning elements offer better performance than the solutions of the known art, because the tabs are separated from each other, and this allows the tabs not only to flex or bend selectively, but also more than what would be possible with a single dome-shaped element under the same conditions, for example leaving the size, thickness and material unchanged. Better performances result in greater comfort for the wearer of the shoe assembled with the sole according to the present invention.

Another advantage is that the cushioning elements deform progressively as the pressure applied thereon increases. Unlike the solution described in EP-A-0875163, in fact, the cushioning elements in the sole of the present invention are provided with elastic tabs that can be deformed independently of each other, instead of a seamless dome. As will be described in more detail, as the tabs flex under the pressure exerted by the wearer of the footwear, they initially are brought into abutment against the elongated element, which acts as stop element, and then they are further bent on themselves, thereby absorbing additional energy. In turn, the elongated element, which is elastic as well, is subjected to the pressure exerted by the wearer and shortens while expanding laterally, while the tabs bend more and more on themselves and remain in abutment against the elongated element.

In other words, the elongated element works by compression and the tabs by flexing.

Therefore, the described deformation of the cushioning elements allows progressive absorption of energy, because the bearing surface given by each cushioning element increases as the deformation increases, by virtue of the deformation its tabs and the elongated element are subjected to. The progressive increase of the bearing surface and the possibility for the tabs to bend even when they are in abutment against the elongated element which is positioned between them, gives the sole excellent performance in terms of stress damping and comfort for the wearer of the footwear manufactured with the sole according to the present invention.

A further advantage is given by the fact that the sole according to the present invention can be molded by using a single polymeric material: the cushioning elements, in fact, can be obtained together with the sole.

Preferably the tabs define a kind of dome and the elongated element is central with respect to the tabs. In other words, the tabs each define a sector of a dome surrounding the elongated element. In this case the term dome has a different meaning with respect to the same term used to identify the elements —dome-shaped ones, as a matter of fact—described in EP-A-0875163: the dome-shaped elements of the known art are single elements without discontinuities, whereas there is a gap between the tabs of the solution according to the present invention.

Preferably the cross section of the elongated element, i.e. the section considered on a plane parallel to the ground on which the sole rests, is either circular, for example it is cylindrical or conical, or ellipsoidal. Alternatively, for example where the cushioning elements are substantially oval, the elongated element has a substantially rectangular cross-section.

Preferably the elongated element extends vertically, i.e. along a direction orthogonal to the upper surface of the sole, between a base and a top end.

In the preferred embodiment of the sole, in the deformed configuration of the cushioning element, the tabs are each partially folded over themselves, in abutment against the elongated element, and they converge, for example up to touch each other side by side.

Preferably the top of the elongated element and the ends of the tabs, i.e. the portions of the tabs that are distal to the upper surface of the sole, together define a bearing surface. As mentioned above, the area of the bearing surface is greater in the deformed configuration of the cushioning element with respect to the area of the bearing surface in the undeformed configuration of the cushioning element. More precisely, the increase in the area of the bearing surface makes it possible to achieve the above-described progressive response to the stresses.

The elongated element substantially acts as a stop element for the tabs during the switching to the deformed configuration of the cushioning element: the ends of the tabs slide vertically on the elongated element while the tabs are bent on themselves to cushion a stress given by the wearer of the footwear.

For example, in a first embodiment, the bearing surface is circular and the respective diameter in the undeformed configuration of the cushioning element is at least 4 mm, and is at least 5 mm in the deformed configuration of the cushioning element, i.e. the difference is at least 1 mm.

Preferably in the undeformed configuration of the cushioning element, the height of the elongated element is, with respect to the upper surface of the sole, equal to the height of the tabs; more preferably, during deformation, the tabs and the elongated element maintain the same height, i.e. they deform together towards the upper surface of the sole, while the height decreases to a minimum.

In the preferred embodiment, the tabs are separated from each other by a cutout, which can also be defined as a slit or slot at the distal end with respect to the upper surface of the sole, and are joined at the base, near the upper surface of the sole in order to give greater strength and prevent the tabs from breaking and separating from the sole.

Preferably the height extent of the cutout between the tabs is 3-8 mm, for example 4-6 mm.

Preferably the width extent of the cutout between the tabs is 1.5-2.5 mm.

Preferably the tabs define a circular, truncated-cone or polygonal dome, e.g. pentagonal or hexagonal.

In an embodiment, the elongated element is either cylindrical and the diameter of the respective cross-section is between 2.5 mm and 7 mm, or is truncated-cone shaped and has a diameter at the base between 3.5 mm and 7 mm and a diameter at the top between 2.5 mm and 5 mm.

Preferably, the height of the elongated element, and in general of the cushioning elements, with respect to the upper surface of the sole is between 3 mm and 30 mm.

In an embodiment, the cushioning elements are, in cross-section—that is, a section considered in a plane either parallel to the ground on which the sole rests or parallel to the upper surface of the sole—circumscribed by a circumference with a diameter between 10 mm and 18 mm. For example, in the case where the dome defined by the tabs has a circular base, the above-mentioned diameter corresponds to the diameter of the base.

Preferably, the tab thickness is between 1.5 mm and 3 mm.

For example, suitable materials to make the sole by molding are rubber, EVA (ethylene vinyl acetate), PU (polyurethane) or TR (thermoplastic rubber).

In general, the cushioning elements can be arranged on the heel portion, i.e. at the hindfoot and midfoot zones, and/or at the toe and/or over the entire upper surface of the sole. For example, the sole can be equipped with either a single, large cushioning element or a plurality of smaller cushioning elements.

In an embodiment, the tabs define a polygonal-section dome, for example pentagonal or hexagonal, and are separated from each other by vertical cutouts, or slits, at the vertices of the polygonal section or at the sides of the polygonal section.

In another embodiment, the tabs define a dome having elongated shape, oval or ellipsoidal, and comprises, inside the dome, one or more elongated elements having for example rectangular section.

BRIEF DESCRIPTION OF THE FIGURES

Further characteristics and advantages of the invention will be more evident from the review of the following specification of some preferred, but not exclusive, embodiments depicted for illustration purposes only and without limitation, with the aid of the attached drawings, wherein:

FIG. 7 is a schematic plan view of a second cushioning element;

FIG. 8 is a schematic plan view of a third cushioning element;

FIG. 9 is a perspective side view of a third embodiment of the sole according to the present invention.

DETAILED DESCRIPTION OF THE INVENTION

Figure 1:
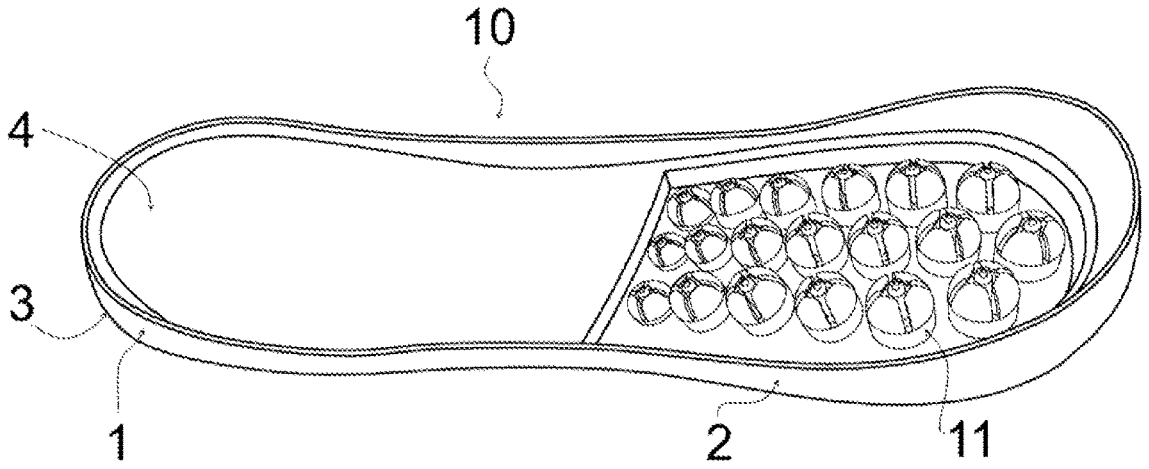
FIG. 1 is a perspective side view of a first embodiment of the sole according to the present invention.

FIG. 1 is a perspective view of a sole 10 according to a first embodiment of the present invention, which comprises a front portion 1 intended to support the front portion of the foot of the wearer of the footwear made with the sole 10, and a back portion 2 at the hindfoot (heel) and midfoot zones of the wearer's foot. The lower surface 3 of the sole 10 is the one intended to come into contact with the ground during the walk; the opposite upper surface 4 is intended to support an insole, for example the insole of an upper assembly of the footwear.

In the example shown in FIG. 1, at the rear portion 2, on the upper surface 4, the sole 10 comprises a plurality of elastically deformable cushioning elements 11, whose function is to absorb the stresses given to the sole during the walk, and to dampen, i.e. to cushion, the stresses transmitted back to the wearer's foot, in order to make the walk comfortable.

The number and position of the cushioning elements are construction parameters on which the designer has a margin of choice: for example, the cushioning elements 11 can be positioned only on the front portion 1, only on the rear portion 2, or on both of them; the cushioning elements 11 can have an even deployment, i.e. a constant pitch (constant distance), and can be deployed in rows, or in an array.

It can be understood that in the soles 10 for children's footwear the number of cushioning elements 11 is lower than in the soles 10 for adult footwear; even the size may differ: smaller for children, larger for adults.

Figure 2:
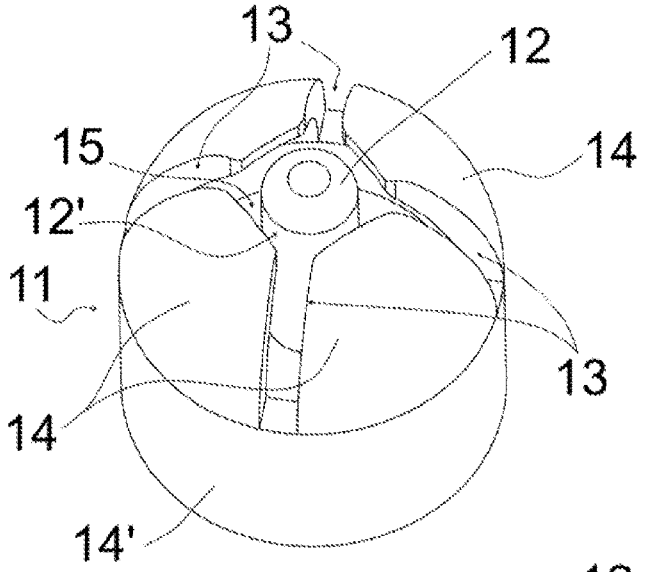
FIG. 2 is an enlargement of a detail of FIG. 1, in particular a first cushioning element, in a first configuration.

FIG. 2 is an enlargement of one of the cushioning elements 11 shown in FIG. 1. The cushioning elements 11 comprise an elongated element 12, which can also be defined protrusion, vertically extending from the upper surface 4 of sole 10, orthogonally thereto. In the figures, the elongated element 12 has a substantially cylindrical shape and therefore circular cross-section, although other geometric shapes, such as a truncated cone, are not excluded. The expression cross-section means the section considered on a plane parallel to the ground on which the sole rests, i.e. a plane parallel to the lower surface 3 of the sole 10, or a plane parallel to the upper surface 4. The elongated element 12 can also have, for example, a square, rectangular, or ellipsoidal cross-section.

The cushioning elements 11 further comprise a plurality of tabs 14 arranged around the elongated element 12 to define a kind of dome. The tabs 14 are separated by cutouts 13, which can also be defined as cutouts or slits. It should be noted that the dome-shaped elements described in relation to the known art are free of the cutouts 13, i.e. they have no tabs.

In the example shown in the figures, there are four tabs 14, likewise the cutouts 13, but in general the number of tabs 14, and therefore the number of cutouts 13, can be different, for example three, five, six, etc.

The tabs 14 substantially extend in the vertical direction and are elastic, i.e. they are susceptible to elastically flex in the direction of the elongated element 12, and vice versa. The elongated element 12 is also elastic, and for this reason it is deformable in compression, as will be explained below.

Preferably, as shown in the example of FIG. 2, the tabs 14 define a circular dome.

In the undeformed configuration of the cushioning elements 11, i.e. in the resting condition shown in FIG. 2 and corresponding to the absence of weight applied by the wearer to the sole 10, the tabs 14 are upright and there is a gap 15 between the tabs and the elongated element 12. The curvature of the tabs 14 visible in FIG. 2 is the normal curvature at rest: the tabs define a dome around the elongated element 12. The free ends of the tabs 14 and the top of the elongated element 12 define a bearing surface of the insole of the footwear. It is precisely on this bearing surface that the weight of the footwear wearer is transferred.

Figure 3:
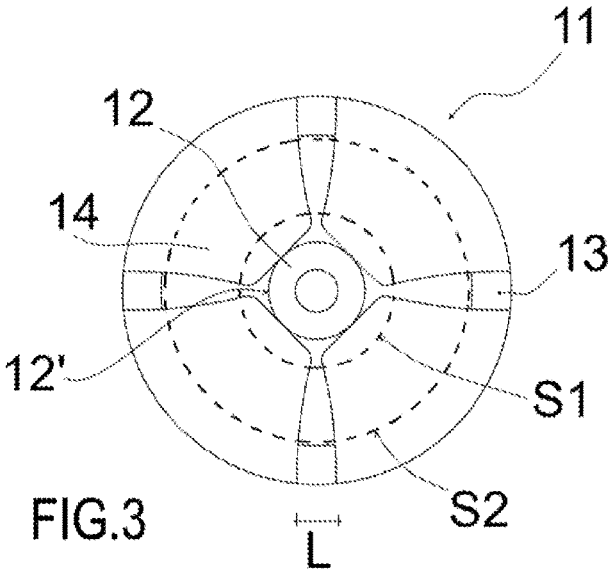
FIG. 3 is a plan top view of a detail of FIG. 1, in particular a first cushioning element, in a second configuration.

During the walk, the wearer of the shoe loads the sole 10 with his own weight, i.e. exerts pressure on the sole 10, towards the ground. FIG. 3 is a top view of a cushioning element 11 in a deformed configuration. As it can be noted, the tabs 14—subjected to the pressure given by the wearer—have deformed, flexing and converging on the elongated element 12, which acts as stop element. The gap 15 initially present between the free ends of the tabs 14 and the elongated element 12 has been eliminated and the ends of the tabs have been brought in abutment against the side surface 12' of the elongated element. In this condition, the tabs 14 can return to the undeformed configuration shown in FIG. 2, if the stress that caused their bending is no more present, or they can continue to flex on themselves, if the stress increases, and in the latter case the ends of the tabs 14 slide on the side surface 12' of the elongated element 12.

Still referring to FIG. 3, the circumference S1 depicted by dashed line circumscribes the bearing surface in the undeformed configuration of the cushioning element 11. Preferably, the diameter of the bearing surface in the undeformed configuration is at least 4 mm. In the deformed configuration of the cushioning element 11, the circumference S2 depicted by dashed line circumscribes the bearing surface. Preferably, the diameter of the bearing surface in the deformed configuration is at least 5 mm.

In other words, when the weight of the footwear wearer is applied to the sole 10, the tabs 14 are pushed downwards, i.e. towards the upper surface 4 of the sole 10 itself and this causes the tabs 14 to flex towards the elongated element 12. The tabs 14 converge on the elongated element 12 and the bearing surface increases: the area circumscribed by the circumference S2 is greater than the area circumscribed by the circumference S1.

The advantage of this solution has been described above: the load damping, and therefore the reaction provided by the sole 10, are progressive and the comfort felt by the wearer is considerable.

Figure 4:
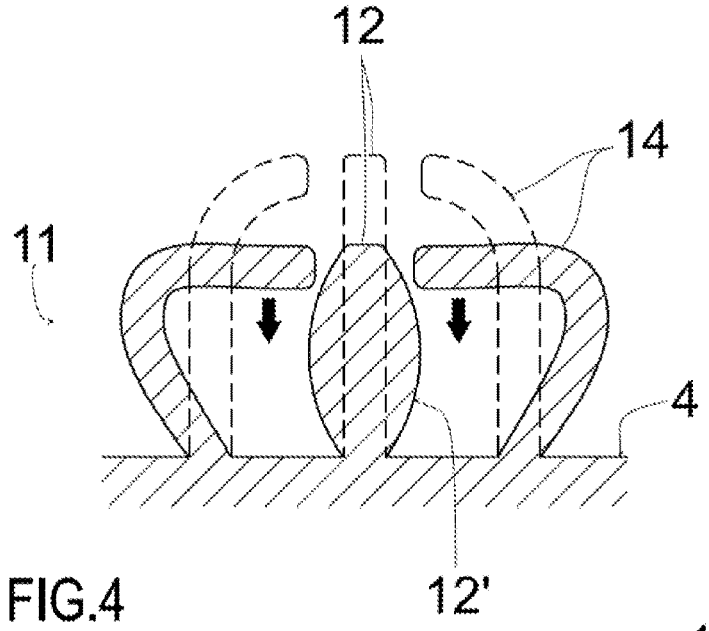
FIG. 4 is a schematic, vertical section view of a detail of FIG. 1, in particular a first cushioning element.

FIG. 4 is a schematic view of a cushioning element 11 in vertical section, i.e. in a vertical plane orthogonal to the lower surface 3 of the sole 10. The cushioning element 11 is depicted by dashed lines in the undeformed configuration, and by continuous lines in the deformed configuration. As can be seen, the elastic deformation affects both the elongated element 12, which works by compression, and the tabs 14, which work by flexing. During the deformation, the elongated element is compressed and widens, i.e. it laterally warps, and the tabs 14 bend on themselves and the respective ends rest against the side surface 12' of the elongated element and slide thereon while further flexing as indicated by the arrows.

In the example shown in FIGS. 1-5, the elongated element 12 is cylindrical and the diameter of the respective cross-section is between 2.5 mm and 7 mm; as an alternative, the elongated element 12 can be truncated-cone shaped, for example having a diameter at the base between 3.5 mm and 7 mm and a diameter at the top between 2.5 mm and 5 mm.

In the example shown in FIGS. 1-5, the width L of the cutout 13 between the tabs 14 is equal to 1.5-2.5 mm.

The numeral reference 14' in FIG. 2 denotes the base of the cushioning elements 11. More in particular, as it can be seen, the cutouts 13 do not separate the tabs 14' up to the respective base; the tabs 14 are joined at the same shared base 14'. This solution is for giving greater wear resistance to the tabs 14, i.e. greater strength.

Figure 5:
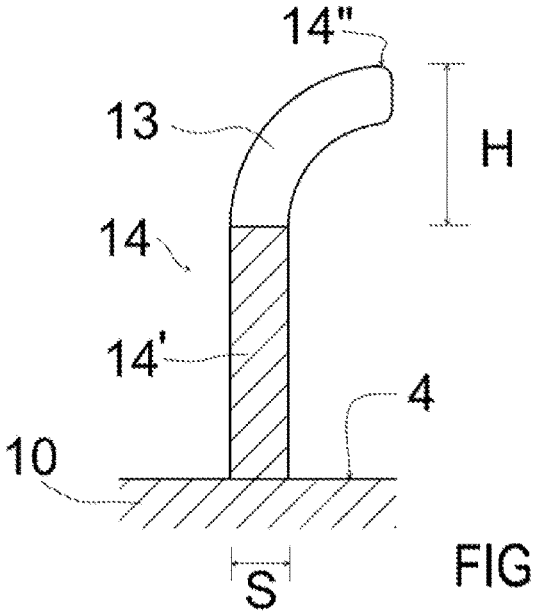
FIG. 5 is a schematic, vertical section view of a detail of FIG. 1, in particular a part of a first cushioning element.

FIG. 5 is a vertical section view of a tab 14 extending from the base 14' shared with the other tabs 14 and a free end 14" distal with respect to the upper surface 4 of the sole 10. The height H of the cutout 13 that separates the tab 14 from another tab 14 is 3-8 mm, for example 4-6 mm. In general, as the height H increases, so does the deformability of the tabs 14, and thus the absorption of impacts and loads by the sole 10 improves. It is preferable, however, that the height H of the cutout 13 does not extend starting from the upper surface 4 of the sole 10, otherwise the sole 10 may become too cushioning thereby risking that a feeling of poor stability is transmitted to the wearer.

Advantageously, within the same sole 10, regions with different values of H can be identified, depending on different needs: for example, at the heel 2 is preferable to have a higher level of cushioning and therefore a value of H greater than for example the middle zone of the foot at the plantar arch.

Preferably, as shown in FIG. 5, the thickness S of the tabs 14 is between 1.5 mm and 2.5 mm.

Preferably the height of elongated element 12, and in general of the cushioning elements 11, with respect to the upper surface of the sole is between 3 mm (the elements closest to the front portion 1 of the sole 10) and 30 mm (the elements furthest from the front portion 1).

Preferably, each circular cushioning element 11 has an outer diameter (cross-section) between 10 mm and 18 mm.

Preferably the elongated element 12 and the tabs 14 have the same height, so that as the tabs 14 bend they cannot pass over the elongated element.

Figure 6:
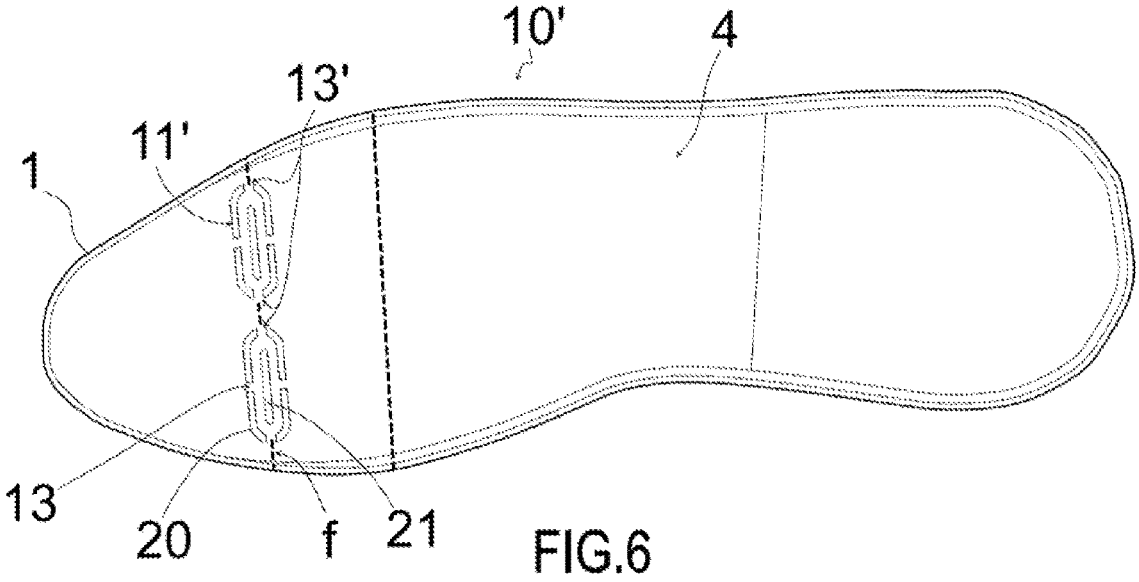
FIG. 6 is a plan top view of a second embodiment of the sole according to the present invention.

FIG. 6 is a plan top view of a second embodiment 10' of the sole, wherein the cushioning elements 11' are positioned on the front portion 1 and are not circular, but have an ellipsoidal shape; the elongated elements 21 have a substantially rectangular or ellipsoidal section, and four tabs 20 extend around a single elongated element 21.

The ellipsoidal shape is preferable when one or more cushioning elements 11' are to be placed in the front portion 1 of the sole 10', the one of the forefoot, thereby combining the cushioning effect with improved flexibility: in this case, the cushioning elements 11' advantageously have a plurality of cutouts 13 having at least some of them, depicted by 13', aligned with the flexing direction f of the sole 10'.

FIGS. 7 and 8 show alternative embodiments 11" and 11'" of the cushioning elements 11, in which the tabs 14 define a polygonal shape, in particular a pentagon, and the elongated element 12 is cylindrical. A polygonal shape, like the pentagon, can be achieved as in FIG. 8 with the cutouts 13'" at the vertices of the polygon, or as in FIG. 7, with the cutouts 13" at an intermediate position between two vertices, for example halfway between two vertices of the polygon. The configuration with the cutouts 13"" at the vertices of the polygon is the least rigid of the two, as the vertices have greater deformation resistance. The configuration with the cutouts 13" at any position between two vertices is advantageous if the hardness of the material constituting the sole 10, 10' cannot be increased, or if the height extension of the cushioning elements 11 would require the walls to be made thicker thus causing an increase in the total weight of the sole and a greater waste of material.

FIG. 9 shows a sole 10" according to the present invention, equipped with a single large cushioning element 11 positioned on the rear portion.

Advantageously, the sole 10, 10' can be made by molding, using for example rubber, EVA (ethylene vinyl acetate), PU (polyurethane) or TR (thermoplastic rubber); the cushioning elements 11, 11', 11", 11'" are obtained with the sole as well, in the same molding step.

The invention claimed is:

1. A footwear sole comprising:

a lower surface, intended to come into contact with the ground;

an upper surface, intended to support an insole; and on the upper surface, at least one elastically deformable cushioning element, wherein the at least one cushioning element includes an elongated element cantileverly protruding from the upper surface of the sole, and a plurality of tabs extending from the upper surface of the sole and that are arranged around the elongated element, wherein in an undeformed configuration of the cushioning element the tabs are upright, and in a deformed configuration of the cushioning element the tabs are bent towards the elongated element and in abutment against the elongated element, wherein a top of the elongated element and ends of the tabs distal with respect to the upper surface of the sole define a bearing surface, and wherein an area of the bearing surface in the deformed configuration of the cushioning element is greater than the area of the bearing surface in the undeformed configuration of the cushioning element.

2. The footwear sole according to claim 1, wherein the tabs define a dome and the elongated element is central with respect to the tabs.

3. The footwear sole according to claim 1, wherein the elongated element has a circular cross-section.

4. The footwear sole according to claim 1, wherein the elongated element extends vertically, orthogonally to the upper surface of the sole, between a base of the elongated element and a respective top of the elongated element.

5. The footwear sole according to claim 1, wherein the bearing surface is circular and the respective diameter in the undeformed configuration of the cushioning element is at least 4 mm, and is at least 5 mm in the deformed configuration of the cushioning element.

6. The footwear sole according to claim 1, wherein the tabs are separated from each other by a cutout, or slit, or slot, at the end distal with respect to the upper surface of the sole, and are joined at the base, near the upper surface of the sole.

7. The footwear sole according to claim 6, wherein the cutout, slit or slot between the tabs has one or more of the following features:

its height extent is 3-8 mm;

its width extent is 1.5-2.5 mm.

8. The footwear sole according to claim 1, wherein the tabs define a circular, truncated-cone or polygonal dome.

9. The footwear sole according to claim 1, wherein the elongated element is either cylindrical and the diameter of the respective cross-section is between 2.5 mm and 7 mm, or is truncated-cone shaped and its diameter at the base measures between 3.5 mm and 7 mm and its diameter at the top measures between 2.5 mm and 5 mm.

10. The footwear sole according to claim 1, wherein the cushioning elements have one or more of the following features:

a height with respect to the upper surface of the sole between 3 mm and 30 mm;

are, in cross-section, circumscribed by a circumference with diameter between 10 mm and 18 mm.

11. The footwear sole according to claim 1, wherein a thickness of the tabs is between 1.5 mm and 3 mm.

12. The footwear sole according to claim 1, wherein during the switching to the deformed configuration of the cushioning element, the tabs are configured to slide on the side surface of the elongated element.

13. The footwear sole according to claim 1, wherein the tabs define a polygonal-section dome and are separated from each other by cutouts, or slits, vertical at the vertices of the polygonal section or at the sides of the polygonal section.

14. The footwear sole according to claim 1, comprising a plurality of cushioning elements arranged on the upper surface, and wherein the cushioning elements positioned at the wearer's heel are larger than the cushioning elements positioned at the middle zone of the wearer's foot.

15. The footwear sole according to claim 6, wherein the cutout between the tabs has one or more of the following features:

a height extent is 4-6 mm; and a width extent is 1.5-2.5 mm.

16. The footwear sole according to claim 1, wherein each tab includes an end surface at an opposite end of the tab from the upper surface of the sole, and includes a side surface extending between the end surface and the upper surface of the sole, wherein in the deformed configuration of the cushioning element, the tabs are bent towards the elongated element and the end surface is in abutment against the elongated element, and wherein in the deformed configuration of the cushioning element, the side surface of each tab defines the bearing surface of each tab.

* * * * *